US005975925A

United States Patent [19]

Tiberio, Jr.

[11] Patent Number: 5,975,925

[45] Date of Patent: Nov. 2, 1999

[54] GROUNDED AND ISOLATED ELECTRICAL RECEPTACLE ASSEMBLIES WITH INTERCHANGEABLE COMPONENTS

[75] Inventor: Patrick J. Tiberio, Jr., Huntington, Conn.

[73] Assignee: Hubbell Incorporated, Orange, Conn.

[21] Appl. No.: 08/939,774

[22] Filed: Sep. 29, 1997

[51] Int. Cl.[6] ..... H01R 4/66

[52] U.S. Cl. ..... 439/107

[58] Field of Search ..... 439/107, 106, 439/652

[56] References Cited

U.S. PATENT DOCUMENTS

| | | | |
|---|---|---|---|
| 4,854,885 | 8/1989 | Bowden, Jr. et al. | 439/107 |
| 5,266,039 | 11/1993 | Boyer et al. | 439/107 |
| 5,472,350 | 12/1995 | Mehta | 439/107 |
| 5,637,000 | 6/1997 | Osterbrock et al. | 439/107 |
| 5,839,908 | 11/1998 | Bonilla et al. | 439/107 |

FOREIGN PATENT DOCUMENTS

| | | | |
|---|---|---|---|
| 651299 | 10/1962 | Canada | 439/107 |

*Primary Examiner*—Neil Abrams
*Assistant Examiner*—Michael C. Zarroli
*Attorney, Agent, or Firm*—Jerry M. Presson; Michael R. Swartz

[57] ABSTRACT

A set of grounded and isolated duplex electrical receptacle assemblies includes interchangeable dual female bodies, interchangeable socket bases, interchangeable right, left and middle contact members, and interchangeable support bridges for assembling either a grounded or an isolated receptacle assembly. In the isolated assembly, an insulator plate is fitted between the support bridge and the middle contact member to electrically isolate one from another to thereby prevent electrical engagement therewith.

22 Claims, 5 Drawing Sheets

GROUNDED AND ISOLATED ELECTRICAL RECEPTACLE ASSEMBLIES WITH INTERCHANGEABLE COMPONENTS

BACKGROUND OF THE INVENTION

1. Field of the Invention

The present invention generally relates to electrical receptacles and, more particularly, is concerned with grounded and isolated electrical receptacle assemblies employing interchangeable receptacle body and base components and right, left and middle contact members as well as one-piece contact members.

2. Description of the Prior Art

Grounded and isolated (or non-grounded) duplex electrical receptacle assemblies heretofore manufactured and marketed by Hubbell Incorporated of Orange, Connecticut, the assignee of the subject application, are respectively illustrated in FIGS. 1 and 2. The grounded and isolated receptacle assemblies A, B employ a first group of components that are substantially the same and thereby interchangeable, and a second group of components that are not the same and thereby not interchangeable. The first group of components in each grounded and isolated assembly A, B includes a receptacle body C and right and left contact members D, E (also commonly referred to in the industry as "line" contacts). The second group of components includes a receptacle base F, a support bridge G, a pair of middle contact elements H (also commonly referred to in the industry as "center" contacts) and a ground tab I of the grounded receptacle assembly A, and a receptacle base J, insulator plate K, middle contact member L and support bridge M of the isolated receptacle assembly B. Neither the respective receptacle bases F, J nor the respective support bridges G, M of the grounded and isolated receptacle assemblies A, B are interchangeable with one another. This means that three interchangeable and eight non-interchangeable, or a total of eleven, components, must be manufactured, inventoried, handled and assembled to provide the grounded and isolated receptacle assemblies A, B.

Furthermore, referring to FIGS. 1–6, even though the right and left contact members D, E of one receptacle assembly A, B are interchangeable with the right and left contact members D, E of the other receptacle assembly A, B, the right and left contact members D, E are each made up of multiple parts which must be manufactured, inventoried, handled and assembled to provide the respective right and left contact members D, E. The same is true with respect to the non-interchangeable middle contacts. For example, the middle contact elements H and the ground tab I of the grounded receptacle assembly A which are mounted on the support bridge G require rivets N to attach them to the support bridge G, while the middle contact member L of the isolated receptacle assembly B includes contact elements O and rivets P to mount them on a binding plate R.

Consequently, a need exists for improvements in the design and construction of grounded and isolated electrical receptacle assemblies that will overcome the aforementioned drawbacks without introducing new drawbacks in their place.

SUMMARY OF THE INVENTION

The present invention provides both grounded and isolated electrical receptacle assemblies which are designed to satisfy the aforementioned needs. The grounded and isolated electrical receptacle assemblies of the present invention employ interchangeable receptacle body and base components and contact members as well as one-piece right, left and middle contact members which substantially reduce the overall number of parts to be manufactured, inventoried and handled and the steps involved in assembling the parts together.

The present invention is directed to a duplex electrical receptacle assembly for receiving electrical male plugs with multiple prongs. The assembly comprises a dual female socket body for receiving electrical male plugs with multiple prongs; a socket base that interfits with the socket body so as to cover the rear side thereof; right middle and left contact members that interfit with respective cavities provided in the socket body; and a support bridge for at least partially surrounding the receptacle assembly and extending along the outer surface of the socket base so as to overlie the middle contact member. The socket body, the socket base and the right, middle and left contact members are interchangeable and are used for constructing both a grounded duplex electrical receptacle assembly and an isolated duplex electrical receptacle assembly. In the grounded assembly, the support bridge overlie and electrically engage with the middle contact member, whereas, in the isolated assembly, an insulator plate is fitted between and electrically isolates the support bridge and the middle contact member from one another to thereby prevent electrical engagement therebetween.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
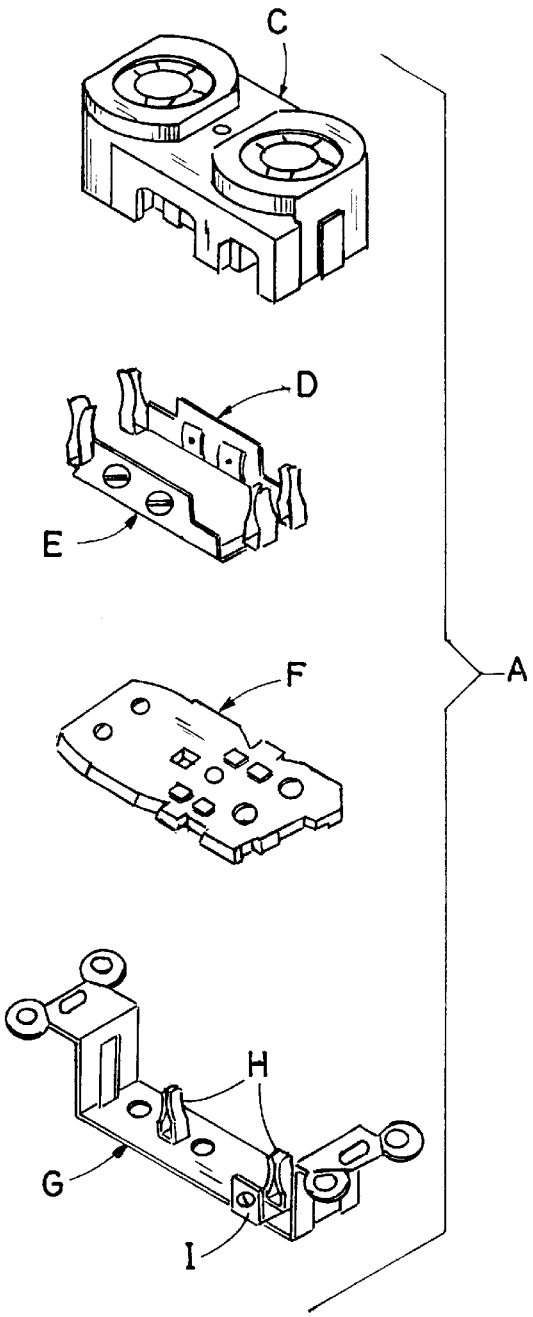
FIG. 1 (PRIOR ART)
FIG. 1 is a front exploded perspective view of a prior art grounded duplex electrical receptacle assembly.
Figure 2:
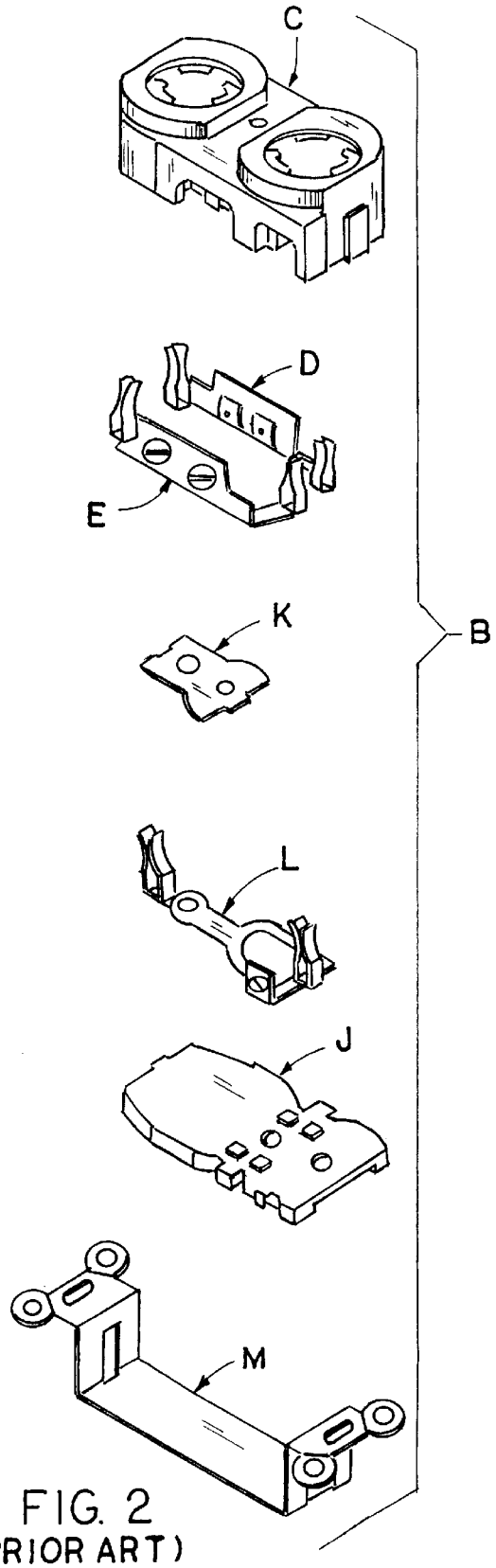
FIG. 2 (PRIOR ART)
FIG. 2 is a front exploded perspective view of a prior art isolated (or non-grounded) duplex electrical receptacle assembly.
Figure 3:
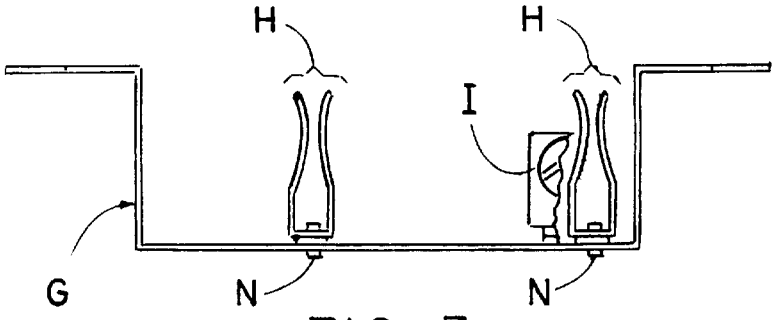
FIG. 3 (PRIOR ART)
FIG. 3 is an enlarged side elevational view of one middle contact member of the prior art grounded assembly of FIG. 1.
Figure 4:
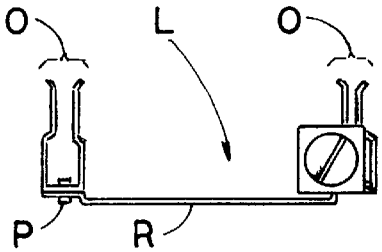
FIG 4 (PRIOR ART)
FIG. 4 is an enlarged side elevational view of another middle contact member of the prior art isolated assembly of FIG. 2.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 7–11, there is illustrated a set of grounded and isolated (non-grounded) duplex electrical receptacle assemblies of the present invention, respectively designated 10 and 10A. The grounded and isolated receptacle assemblies 10, 10A are the type that receive electrical plugs (not shown) which are, first, inserted into the dual sockets 12 of the respective receptacle assemblies 10, 10A and then rotated to make electrical contact. Such grounded and isolated receptacle assemblies 10, 10A are known as twist locking type devices. However, the principles of the present invention can be used in other types of electrical receptacles. Also, although the principles of the present invention are illustrated with reference to duplex receptacle assemblies having dual sockets 12, they equally apply to receptacle assemblies having single sockets.

Figure 7:
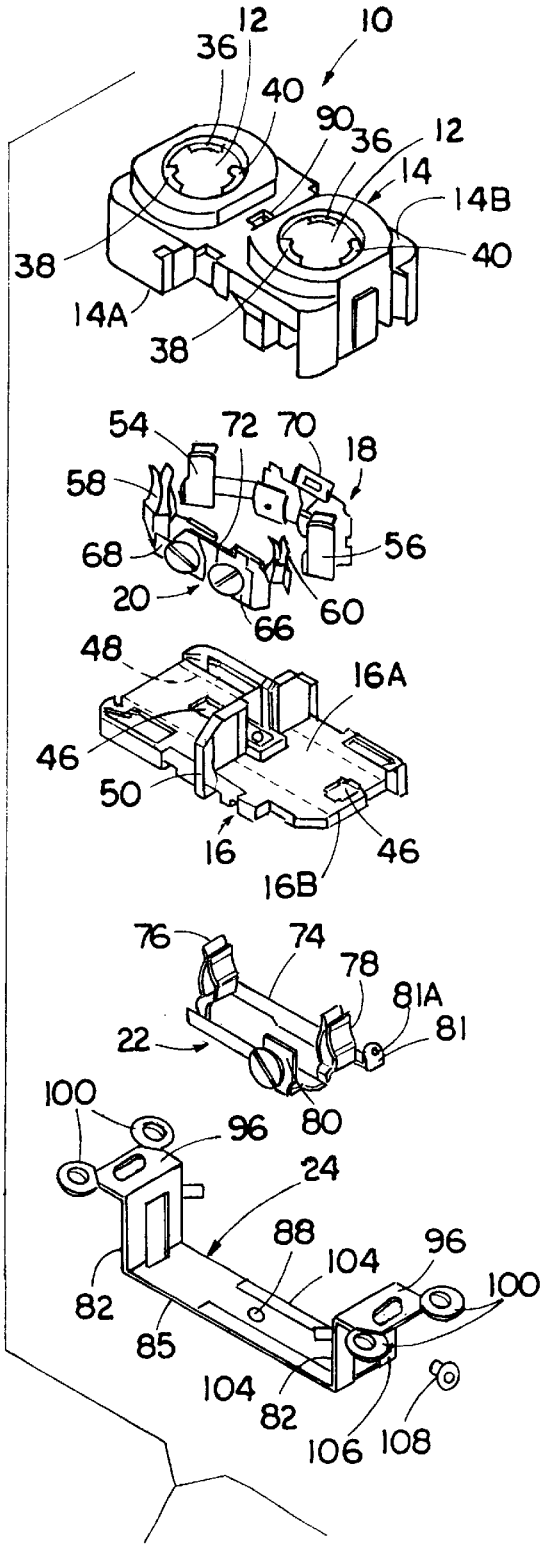
FIG. 7 is a front exploded perspective view of a grounded duplex electrical receptacle assembly of the present invention.
Figure 8:
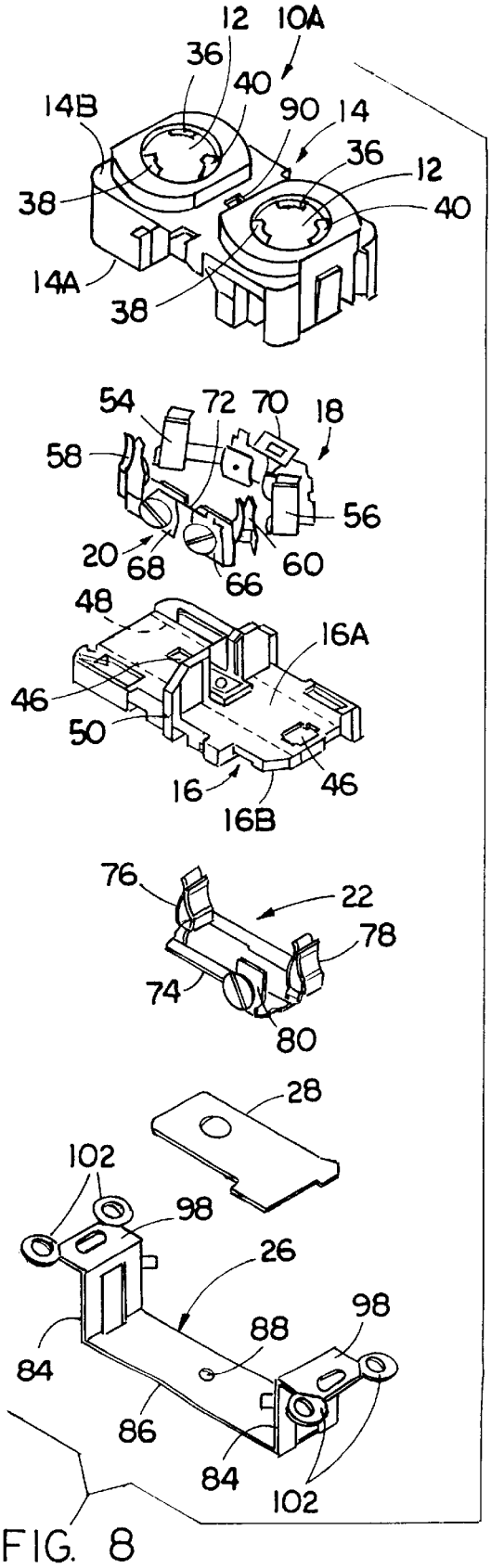
FIG. 8 is a front exploded perspective view of an isolated duplex electrical receptacle assembly of the present invention.

Referring to FIGS. 7 and 8, the set of grounded and isolated duplex electrical receptacle assemblies 10, 10A includes a pair of dual female socket bodies 14 that are interchangeable with one another, a pair of socket bases 16 that are interchangeable with one another, a pair of right contact members 18 that are interchangeable with one another, a pair of left contact members 20 that are interchangeable with one another, and a pair of middle contact members 22 that are interchangeable with one another. The set of grounded and isolated assemblies 10, 10A also include a pair of support bridges 24, 26 that are not interchangeable with one another. Only the isolated assembly 10A includes an insulator plate 28.

Figure 9:
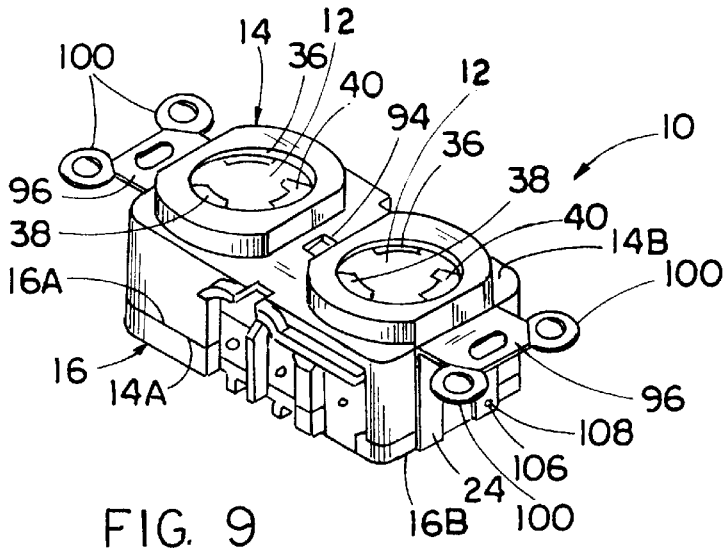
FIG. 9 is a front assembled perspective view of the grounded assembly of FIG. 7.
Figure 11:
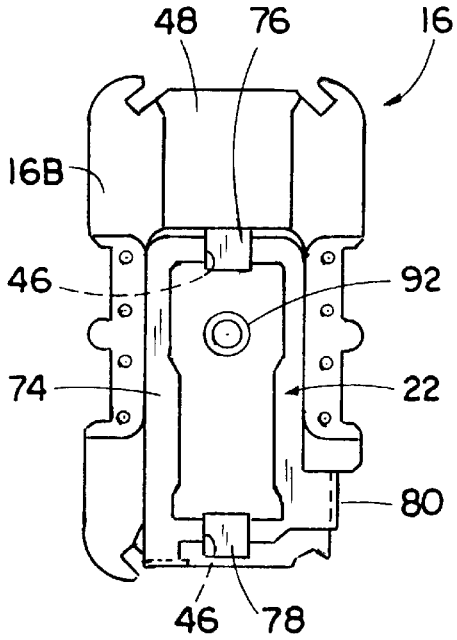
FIG. 11 is a rear plan view of a socket base of both grounded and isolated assemblies of FIGS. 7 and 8 showing the middle contact member disposed in the recess formed in the outer surface of the base and with the contact elements of the middle contact member being disposed within the spaced middle openings in the base.
Figure 10:
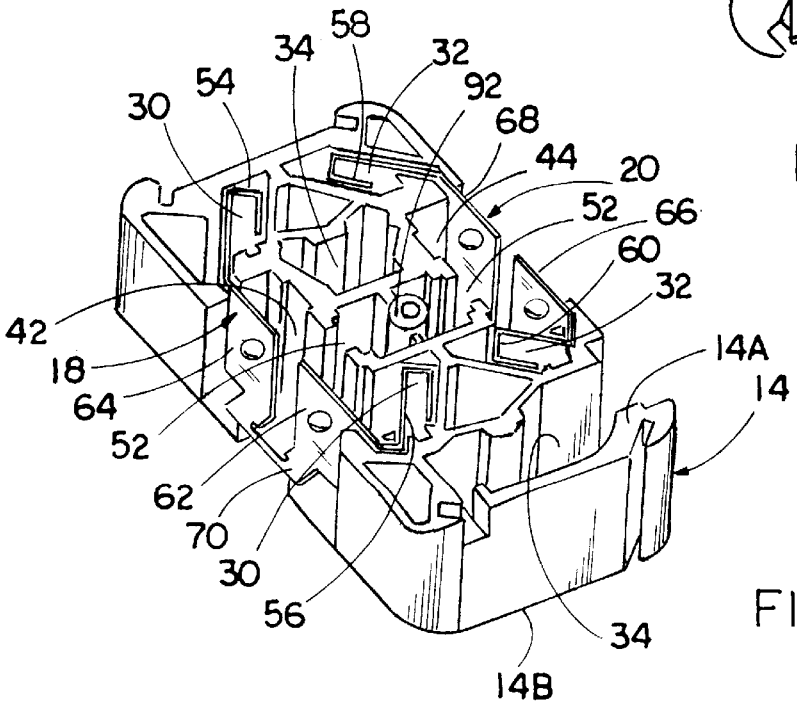
FIG. 10 is a rear perspective view of a dual female socket body of both grounded and isolated assemblies of FIGS. 7 and 8 showing the formed cavities and chambers and with the right and left contact members being disposed within the respective cavities.

Referring to FIGS. 7–11, each interchangeable socket body 14 of the assemblies 10, 10A is generally rectangular shaped and has spaced apart opposite rear and front sides 14A, 14B. As best seen in FIG. 10, formed within each socket body 14 is a pair of longitudinally (or lengthwise) spaced apart right cavities 30, a pair of longitudinally spaced apart left cavities 32 and a pair of longitudinally spaced apart middle cavities 34, all of which are open at the rear side 14A of the socket body 14. Also formed within each socket body 14 is a pair of longitudinally spaced apart prong-receiving right passages 36, a pair of longitudinally spaced apart prong-receiving left passages 38 and a pair of longitudinally spaced apart prong-receiving middle passages 40, all of which are open at the front side 14B of the socket body 14 and lead into corresponding ones of the pairs of right cavities 30, left cavities 32 and middle cavities 34. Further, with particular reference again to FIG. 10, the socket bodies 14 have formed therein a right chamber 42 that extends between and interconnects the pair of right cavities 30 formed therein and a left chamber 44 that extends between and interconnects the pair of left cavities 32 formed therein. The socket bodies 14 of the assemblies 10, 10A thus have substantially identical constructions and thereby are interchangeable with one another for fitting in either one of the grounded and isolated receptacle assemblies 10, 10A for receiving well-known conventional electrical male plugs (not shown) with multiple prongs.

Referring to FIGS. 7 and 8, each interchangeable socket base 16 of the assemblies 10, 10A is generally T-shaped and has spaced apart inner and outer surfaces 16A, 16B. Each socket base 16 has a pair of spaced apart middle openings 46 extending through the socket base 16 between inner and outer surfaces 16A, 16B thereof. Also, each socket base 16 has a longitudinal (or lengthwise) recess 48 formed in the outer surface 16B thereof. Further, each socket base 16 has a pair of laterally (or widthwise) spaced apart middle wall portions 50 that are insertable into slots 52 (see FIG. 10) formed in each socket base 14 adjacent to the right and left passages 36, 38 therein. The socket bases 16 thus have substantially identical constructions and thereby are interchangeable with one another for interfitting with and covering the rear sides 14A of either one of the socket bases 14 of the grounded and isolated receptacle assemblies 10, 10A.

Referring to FIGS. 7, 8 and 12–14, each interchangeable right contact member 18 and each interchangeable left contact member 20 of the assemblies 10, 10A preferably, although not necessarily, have an integrally-formed one-piece construction. The respective right and left contact members 18, 20 could have multi-piece constructions such as was used in the prior art, although such constructions would be much less desirable than the one-piece construction.

Figure 12:
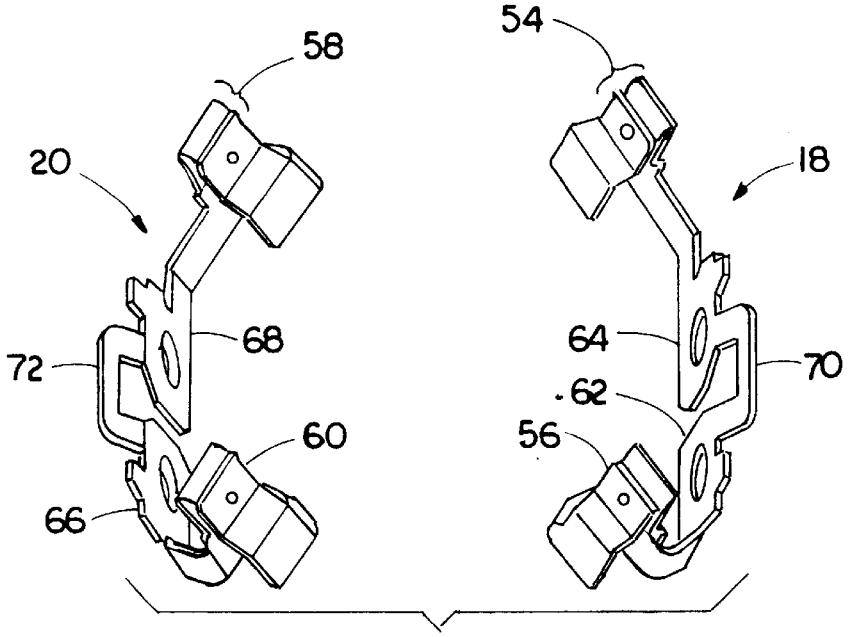
FIG. 12 is an enlarged perspective view of right and left contact members of both grounded and isolated assemblies of FIGS. 7 and 8.
Figure 13:
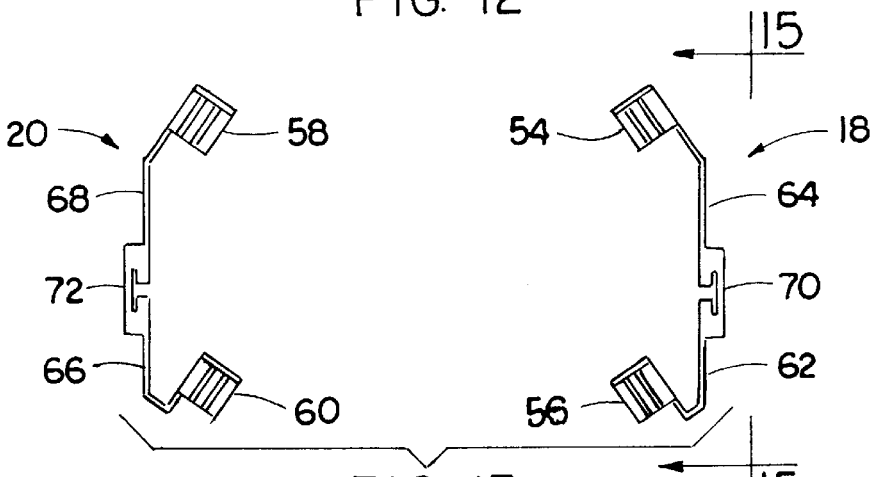
FIG. 13 is a top plan view on a reduced scale of the right and left contact members of FIG. 12.
Figure 14:
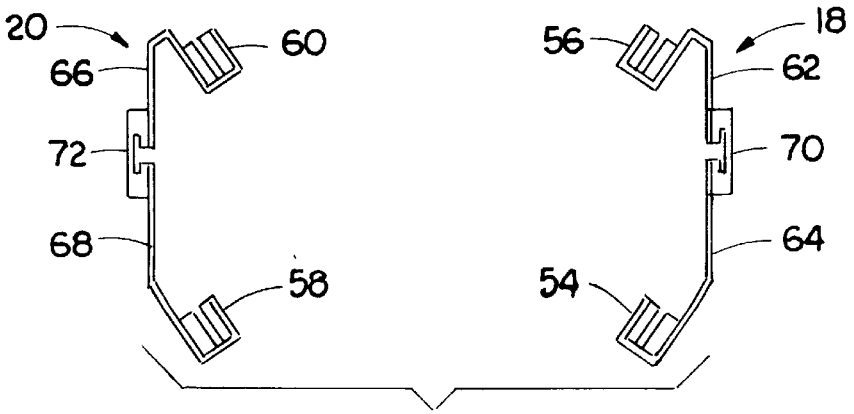
FIG. 14 is a bottom plan view of the right and left contact members of FIG. 12.

More particularly, the right and left contact members 18 and 20, which as seen in FIG. 12 are mirror images of one another, each includes a pair of spaced apart prong-receiving contact elements 54, 56 and 58, 60, a pair of conductor-receiving terminal elements 62, 64 and 66, 68 spaced apart from one another and disposed between the contact elements 54, 56 and 58, 60 and attached to respective ones of the contact elements 54, 56 and 58, 60 and a breakaway tab 70, 72 extending between and detachably attached to the terminal elements 62, 64 and 66, 68. The pair of terminal elements 62, 64 and 66, 68 and their interconnecting breakaway tab 70, 72 of the respective right and left contact members 18, 20 are disposed within the corresponding right and left chambers 42, 44 in each of the socket bodies 14 which extend between and interconnect the respective pairs of right and left cavities 30, 32 therein. The right contact members 18 thus have substantially identical constructions and thereby are interchangeable with one another for interfitting with the right cavities 30 and chamber 42 of either one of the socket bodies 14 of the grounded and isolated receptacle assemblies 10, 10A. Similarly, the left contact members 20 thus have substantially identical constructions and thereby are interchangeable with one another for interfitting with the left cavities 32 and chamber 44 of either one of the socket bodies 14 of the grounded and isolated receptacle assemblies 10, 10A.

Referring to FIGS. 7 and 8, each interchangeable middle contact member 22 of the assemblies 10, 10A preferably, although not necessarily, also has an integrally-formed one-piece construction. Each middle contact member 22 includes an annular strip-like plate 74, a pair of spaced apart contact elements 76, 78 attached to strip-like plate 74, a terminal element 80 disposed between the contact elements 76, 78 and attached to the strip-like plate 74 and a breakaway ground terminal tab 81 disposed adjacent to the contact element 78 and detachably attached to the strip-like plate 74. The middle contact members 22 thus have substantially identical constructions and thereby are interchangeable with one another for interfitting their contact elements 76, 78 with the spaced apart middle cavities 34 of either one of the socket bodies 14 of the grounded and isolated receptacle assemblies 10, 10A and for also extending their contact elements 76, 78 through the spaced apart middle openings 46, and extending their strip-like plates 74 along and disposed adjacent to the outer surface 16B, of either one of the socket bases 16 of the grounded and isolated receptacle assemblies 10, 10A.

Referring again to FIGS. 7–11, the support bridges 24, 26 of the respective grounded and isolated assemblies 10, 10A are provided to surround the socket bases 16 and at least partially surround the socket bodies 14 of the respective assemblies 10, 10A. Each support bridge 24, 26 has a generally U-shaped "wrap-around" configuration which includes a pair of opposite end portions 82, 84 and a middle portion 85, 86 extending generally transversely to and between and interconnecting the opposite end portions 82, 84. The middle portion 85, 86 extends along and is seated within the longitudinal recess 48 in the outer surface 16B of the respective one socket base 14. Also, the middle portion 85, 86 of each support bridge 24, 26 has an aperture 88 for receiving an elongated fastener (not shown), such as a conventional bolt, which extends through a central hole 90 in each socket base 16 and a central hollow tubular post 92 in each socket body 14. A complementary fastener element 94, such as a nut, is threaded onto a threaded end of the fastener for securing the socket body 14 and base 16 to one another and to the middle portion of the support bridge 24, 26, as seen in FIG. 9. Also, the support bridge 24, 26 has pairs of mounting tabs 96, 98 attached to and extending in opposite directions respectively outwardly from the opposite end portions 82, 84 of the support bridge 24, 26 and in generally parallel relation to the middle portion 85, 86 thereof. The mounting tabs 96, 98 have eyelets 100, 102 defined therethrough for fastening the support bridge 24, 26 to a structure, such as a building wall, by the use of conventional screws (not shown) inserted through the eyelets 100, 102 and threaded into the structure.

If it were not for the need to provide electrical isolation between the support bridge 26 and the middle contact member 22 of the isolated receptacle assembly 10A, the support bridges 24, 26 would be substantially identical and thus interchangeable. Each of the bridges 24, 26 extends along the outer surface 16B of the respective ones of the socket bases 16 so as to overlie and potentially provide electrical engagement with the respective middle contact members 22 disposed adjacent to the outer surface 16B of the respective socket bases 16. However, the insulator plate 28 is provided for fitting within the isolated receptacle assembly 10A between and electrically isolating from one another the one support bridge 26 and middle contact member 22 of the isolated receptacle assembly 10A to thereby prevent electrical engagement between the support bridge 26 and middle contact member 22 of the isolated receptacle assembly as seen in FIG. 8. The insulator plate 28 being of thin flat configuration is disposed within the longitudinal recess 48 in the outer surface 16B of the respective one socket base 16 of only the isolated receptacle assembly 10A, between the middle contact member 22 and middle portion 86 of the one support bridge 26 of only the isolated receptacle assembly 10A. To compensate for the space left by the absence of the insulator plate 26 in the grounded receptacle assembly 10 and to make electrical engagement with the annular plate 74 of the one middle contact member 22, a pair of ribs 104 are embossed on the middle portion 85 of the one support bridge 24.

Also, one of the opposite end portions 82 of the support bridge 24 for the grounded receptacle assembly 10 has an aperture 106 formed therein which aligns with an aperture 81A of the breakaway ground terminal tab 81 on the one middle contact member 22 fitted with the grounded receptacle assembly 10. The aligned apertures 106, 81A receive a conductive coupler 108, such as a rivet, to provide electrical contact therebetween.

Figure 15:
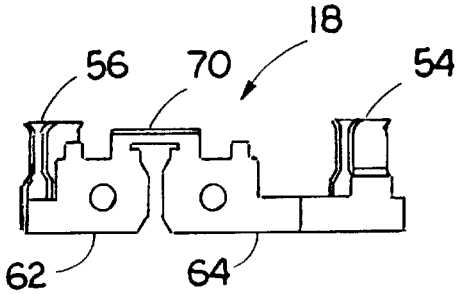
FIG. 15 is a side elevational view of the right contact member as seen along line 15—15 of FIG. 13 with a breakaway tab intact.
Figure 5:
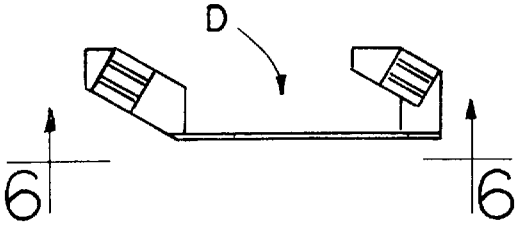
FIG. 5 (PRIOR ART)
FIG. 5 is an enlarged top plan view of a left contact member of both prior art grounded and isolated assemblies of FIGS. 1 and 2.
Figure 16:
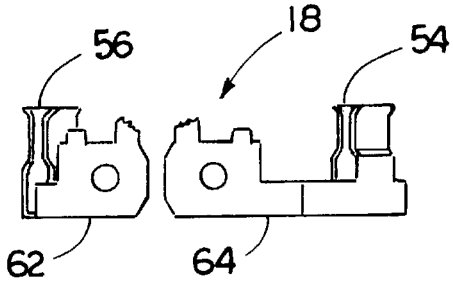
FIG. 16 is a side elevational view of the right contact member similar to that of FIG. 15 but with the breakaway tab removed.
Figure 6:
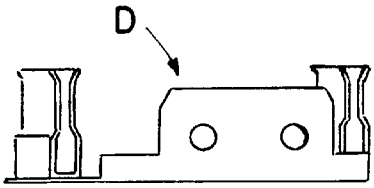
FIG 6 (PRIOR ART)
FIG. 6 is a side elevational view of the prior art left contact member as seen along line 6—6 of FIG. 5.

Referring to FIG. 15, the breakaway tab 70, 72 of the right and left contact members 18, 20 are usually left intact so as to provide the contact elements in the duplex receptacle assembly 10, 10A on the same electrical circuit. When it is desired to provide the contact elements on two separate circuits, the breakaway tab 70, 72 is removed, as seen in FIG. 16.

The socket bodies 14 and bases 16 and the insulator plate 28 are preferably fabricated by suitable conventional injection molding techniques using suitable electrically non-conductive plastic materials. The right, left and middle contact members 18, 20, 22 are preferably made of suitable electrically conductive metallic materials.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms described heretofore merely being preferred or exemplary embodiments thereof.

I claim:

1. A grounded duplex electrical receptacle assembly for receiving electrical male plugs with multiple prongs, said assembly comprising:

(a) a dual female socket body for receiving electrical male plugs with multiple prongs, said female socket body having spaced apart opposite front and rear sides, pairs of spaced apart right cavities, left cavities and middle cavities being open at said rear side, and pairs of spaced apart prong-receiving right passages, left passages and middle passages being open at said front side and leading into corresponding ones of said pairs of right cavities, left cavities and middle cavities;

(b) a socket base for interfitting with said socket body so as to cover said rear side thereof, said socket base having spaced apart opposite inner and outer surfaces and a pair of middle openings extending through said socket base between said inner and outer surfaces thereof, said socket base at said inner surface being disposed adjacent to said rear side of said socket body, said socket base having a recess formed in said outer surface thereof;

(c) a right contact member for interfitting with said right cavities of said socket body;

(d) a left contact member for interfitting with said left cavities of said socket body;

(e) a middle contact member for interfitting with said middle cavities of said socket body and for extending through said middle openings, and extending along and disposed adjacent to said outer surface of said socket base; and (f) a support bridge for at least partially surrounding said grounded receptacle assembly and extending along said outer surface of said socket base so as to overlie and electrically engage with said middle contact member disposed adjacent to said outer surface of said socket base, said support bridge having a pair of opposite end portions and a middle portion extending between and interconnecting said opposite end portions, said middle portion of said support bridge extending along and seated within said recess in said outer surface of said socket base.

2. The receptacle assembly as recited in claim 1, wherein each of said right, left and middle contact members has an integrally-formed one-piece construction.

3. The receptacle assembly as recited in claim 1, wherein each of said right and left contact members includes a pair of spaced apart contact elements, a pair of terminals spaced apart from one another and disposed between said contact elements and attached to respective ones of said contact elements, and a breakaway tab extending between and detachably attached to said terminals, said pair of terminals and said breakaway tab of each of said right and left contact members being disposed within corresponding right and left chambers in each of said socket bodies that extend between and interconnect said respective pairs of right and left cavities therein.

4. The receptacle assembly as recited in claim 1, wherein said middle contact member includes strip means, a pair of spaced apart contact elements attached to said strip means, a terminal disposed between said contact elements and attached to said strip means and a breakaway ground terminal disposed adjacent to one of said contact elements and detachably attached to said strip means.

5. An isolated duplex electrical receptacle assembly for receiving electrical male plugs with multiple prongs, said assembly comprising:

(a) a dual female socket body for receiving electrical male plugs with multiple prongs, said female socket body having spaced apart opposite front and rear sides, pairs of spaced apart right cavities, left cavities and middle cavities being open at said rear side, and pairs of spaced apart prong-receiving right passages, left passages and middle passages being open at said front side and leading into corresponding ones of said pairs of right cavities, left cavities and middle cavities;

(b) a socket base for interfitting with said socket body so as to cover said rear side thereof, said socket base having spaced apart opposite inner and outer surfaces and a pair of middle openings extending through said socket base between said inner and outer surfaces thereof, said socket base at said inner surface being disposed adjacent to said rear side of said socket body;

(c) a right contact member for interfitting with said right cavities of said socket body;

(d) a left contact member for interfitting with said left cavities of said socket body;

(e) a middle contact member for interfitting with said middle cavities of said socket body and for extending through said middle openings, and extending along and disposed adjacent to said outer surface of said socket base;

(f) a support bridge for at least partially surrounding said isolated receptacle assembly and extending along said outer surface of said socket base so as to overlie said middle contact member disposed adjacent to said outer surface of said socket base; and (g) an insulator plate for fitting between and electrically isolating from one another said support bridge and middle contact member to thereby prevent electrical engagement therebetween.

6. The receptacle assembly as recited in claim 5, wherein:

said socket base has a recess formed in said outer surface thereof; and said support bridge has a pair of opposite end portions and a middle portion extending between and interconnecting said opposite end portions, said middle portion of said support bridge extending along and seated within said recess in said outer surface of said socket base.

7. The receptacle assembly as recited in claim 6, wherein said insulator plate is disposed within said recess in said outer surface of said socket base and between said middle contact member and said middle portion of said support bridge.

8. The receptacle assembly as recited in claim 5, wherein each of said right, left and middle contact members has an integrally-formed one-piece construction.

9. The receptacle assembly as recited in claim 5, wherein each of said right and left contact members includes a pair of spaced apart contact elements, a pair of terminals spaced apart from one another and disposed between said contact elements and attached to respective ones of said contact elements, and a breakaway tab extending between and detachably attached to said terminals, said pair of terminals and said breakaway tab of each of said right and left contact members being disposed within corresponding right and left chambers in each of said socket bodies that extend between and interconnect said respective pairs of right and left cavities therein.

10. The receptacle assembly as recited in claim 5, wherein said middle contact member includes strip means, a pair of spaced apart contact elements attached to said strip means, a terminal disposed between said contact elements and attached to said strip means and a breakaway ground terminal disposed adjacent to one of said contact elements and detachably attached to said strip means.

11. A set of grounded and isolated electrical receptacle assemblies for receiving electrical male plugs with multiple prongs, said set comprising:

(a) a pair of female socket bodies interchangeable with one another for fitting in either one of said grounded and isolated receptacle assemblies for receiving electrical male plugs with multiple prongs, each of said socket bodies having spaced apart opposite front and rear sides, at least one right cavity, left cavity and middle cavity all being open at said rear side, and at least one prong-receiving right passage, left passage and middle passage all being open at said front side and leading into corresponding ones of said right cavity, left cavity and middle cavity;

(b) a pair of socket bases interchangeable with one another for interfitting with and covering said rear sides of either one of said socket bodies, each of said socket bases having spaced apart inner and outer surfaces and at least one middle opening extending through said socket base between said inner and outer surfaces thereof, each of said socket bases at said inner surface thereof being disposed adjacent to said rear side of either one of said socket bodies;

(c) a pair of right contact members interchangeable with one another for interfitting with said at least one right cavity of either one of said socket bodies of said grounded and isolated receptacle assemblies;

(d) a pair of left contact members interchangeable with one another for interfitting with said at least one left cavity of either one of said socket bodies of said grounded and isolated receptacle assemblies;

(e) a pair of middle contact members interchangeable with one another for interfitting with said at least one middle cavity of either one of said socket bodies of said grounded and isolated receptacle assemblies and for extending through said at least one middle opening, and extending along and disposed adjacent to said outer surface, of either one of said socket bases of said grounded and isolated receptacle assemblies;

(f) a pair of support bridges each for at least partially surrounding a respective one of said grounded and isolated receptacle assemblies and extending along said outer surface of a respective one of said socket bases of said grounded and isolated receptacle assemblies so as to overlie and provide electrical engagement with a respective one of said middle contact members disposed adjacent to said outer surface of said respective one socket base; and (g) an insulator plate for fitting between and electrically isolating from one another said support bridge and said middle contact member of only said isolated receptacle assembly to thereby prevent electrical engagement between said support bridge and said middle contact member of only said isolated receptacle assembly.

12. The set of receptacle assemblies as recited in claim 11, wherein:

each of said socket bases has a recess formed in said outer surface thereof;

each of said support bridge has a pair of opposite end portions and a middle portion extending between and interconnecting said opposite end portions, said middle portion of a respective one of said support bridges extending along and seated within said recess in said outer surface of a respective one of said socket bases.

13. The set of receptacle assemblies as recited in claim 12, wherein said insulator plate is disposed within said recess in said outer surface of said respective one socket base of only said isolated receptacle assembly and between said middle contact member and said middle portion of said support bridge of only said isolated receptacle assembly.

14. The set of receptacle assemblies as recited in claim 11, wherein each of said right, left and middle contact members has an integrally-formed one-piece construction.

15. The set of receptacle assemblies as recited in claim 11, wherein each of said right and left contact members includes at least one contact element and at least one terminal attached to said contact element.

16. The set of receptacle assemblies as recited in claim 11, wherein said middle contact member includes strip means, at least one contact element attached to said strip means, at least one terminal attached to said strip means and a break-away ground terminal disposed adjacent to said contact element and detachably attached to said strip means.

17. A set of grounded and isolated duplex electrical receptacle assemblies for receiving electrical male plugs, said set comprising:

(a) a pair of dual female socket bodies interchangeable with one another for fitting in either one of said grounded and isolated receptacle assemblies for receiving electrical male plugs with multiple prongs, each of said socket bodies having spaced apart opposite front and rear sides, pairs of spaced apart right cavities, left cavities and middle cavities being open at said rear side, and pairs of spaced apart prong-receiving right passages, left passages and middle passages being open at said front side and leading into corresponding ones of said pairs of right cavities, left cavities and middle cavities;

(b) a pair of socket bases interchangeable with one another for interfitting with and covering said rear sides of either one of said socket bases, each of said socket bases having spaced apart inner and outer surfaces and spaced apart middle openings extending through said socket bases between inner and outer surfaces thereof;

(c) a pair of right contact members interchangeable with one another for interfitting with said spaced apart right cavities of either one of said socket bodies of said grounded and isolated receptacle assemblies;

(d) a pair of left contact members interchangeable with one another for interfitting with said spaced apart left cavities of either one of said socket bodies of said grounded and isolated receptacle assemblies;

(e) a pair of middle contact members interchangeable with one another for interfitting with said middle cavities of either one of said socket bodies of said grounded and isolated receptacle assemblies and for extending through said spaced apart middle openings, and extending along and disposed adjacent to said outer surface, of either one of said socket bases of said grounded and isolated receptacle assemblies;

(f) a pair of support bridges each for at least partially surrounding a respective one of said grounded and isolated receptacle assemblies and extending along said outer surface of a respective one of said socket bases of said grounded and isolated receptacle assemblies so as to overlie and provide electrical engagement with a respective one of said middle contact members disposed adjacent to said outer surface of said respective one socket base; and (g) an insulator plate for fitting between and electrically isolating from one another said support bridge and said middle contact member of only said isolated receptacle assembly to thereby prevent electrical engagement between said support bridge and middle contact member of only said isolated receptacle assembly.

18. The set of receptacle assemblies as recited in claim 17, wherein:

each of said socket bases has a recess formed in said outer surface thereof;

each of said support bridges has a pair of opposite end portions and a middle portion extending between and interconnecting said opposite end portions, said middle portion of a respective one of said support bridges extending along and seated within said recess in said outer surface of a respective one of said socket bases.

19. The set of receptacle assemblies as recited in claim 18, wherein said insulator plate is disposed within said recess in said outer surface of said respective one socket base of only said isolated receptacle assembly and between said middle contact member and said middle portion of said support bridge of only said isolated receptacle assembly.

20. The set of receptacle assemblies as recited in claim 17, wherein each of said right, left and middle contact members has an integrally-formed one-piece construction.

21. The set of receptacle assemblies as recited in claim 18, wherein each of said right and left contact members includes a pair of spaced apart contact elements, a pair of terminals spaced apart from one another and disposed between said contact elements and attached to respective ones of said contact elements, and a breakaway tab extending between and detachably attached to said terminals, said pair of terminals and said breakaway tab of each of said right and left contact members being disposed within corresponding right and left chambers in each of said socket bodies that extend between and interconnect said respective pairs of right and left cavities therein.

22. The set of receptacle assemblies as recited in claim 17, wherein said middle contact member includes strip means, a pair of spaced apart contact elements attached to said strip means, a terminal disposed between said contact elements and attached to said strip means and a breakaway ground terminal disposed adjacent to one of said contact elements and detachably attached to said strip means.

* * * * *